US009550130B2

(12) United States Patent
Pettey

(10) Patent No.: US 9,550,130 B2
(45) Date of Patent: Jan. 24, 2017

(54) KITS AND COMPONENTS FOR MODULAR HOBBY MECHANICAL AND ROBOTIC CONSTRUCTION

(75) Inventor: Brian T. Pettey, Winfield, KS (US)

(73) Assignee: ROBOTZONE, LLC, Winfield, KS (US)

( * ) Notice: Subject to any disclaimer, the term of this patent is extended or adjusted under 35 U.S.C. 154(b) by 751 days.

(21) Appl. No.: 12/412,686

(22) Filed: Mar. 27, 2009

(65) Prior Publication Data

US 2009/0247045 A1 Oct. 1, 2009

Related U.S. Application Data

(60) Provisional application No. 61/072,299, filed on Mar. 28, 2008.

(51) Int. Cl.
*A63H 33/04* (2006.01)
*A63H 33/10* (2006.01)

(52) U.S. Cl.
CPC ..... *A63H 33/042* (2013.01); *A63H 33/107* (2013.01); *Y10T 29/49826* (2015.01)

(58) Field of Classification Search
USPC .... 446/90, 122–123, 108–116; 403/301, 404
See application file for complete search history.

(56) References Cited

U.S. PATENT DOCUMENTS

| | | | | |
|---|---|---|---|---|
| 1,166,688 | A * | 1/1916 | Hornby | 403/218 |
| 1,763,302 | A * | 6/1930 | Gilbert | 446/90 |
| 1,789,896 | A * | 1/1931 | Gilbert | 446/103 |
| 1,792,976 | A * | 2/1931 | Gilbert | 446/112 |
| 2,082,138 | A * | 6/1937 | Badel | 446/113 |
| 2,095,700 | A * | 10/1937 | Heede | 446/113 |
| 3,355,837 | A * | 12/1967 | Pedersen | 446/94 |
| 4,274,036 | A * | 6/1981 | Fukasaku et al. | 388/821 |
| 7,243,562 | B2 * | 7/2007 | Enright | 74/89.22 |
| 7,284,457 | B2 * | 10/2007 | Jinno et al. | 74/1 R |

* cited by examiner

*Primary Examiner* — Gene Kim
*Assistant Examiner* — Matthew B Stanczak
(74) *Attorney, Agent, or Firm* — Katherine M Scholz; Kelly, Holt & Christenson, PLLC

(57) ABSTRACT

Hobby mechanical kits are provided. Kits illustratively include a hobby servo motor having a rotatable output shaft. The output shaft has gear teeth distributed around an outer diameter of the shaft. Certain embodiments of kits also include a hobby servo horn and a channel. The hobby servo horn has an inner diameter with gear teeth that correspond to the hobby servo output shaft gear teeth. The channel has a first panel, a second panel, and a third panel. The hobby servo horn and one of the panels of the channel include a star-shaped connection point.

24 Claims, 16 Drawing Sheets

KITS AND COMPONENTS FOR MODULAR HOBBY MECHANICAL AND ROBOTIC CONSTRUCTION

The present application is based on, and claims the benefit of U.S. provisional application 61/072,299, filed on Mar. 28, 2008. The content of which is hereby incorporated by reference in its entirety.

BACKGROUND

The present invention generally pertains to the hobby-mechanical industry. More specifically, the present invention pertains to various kits and components that are assembled in virtually unlimited combinations to form virtually unlimited hobby mechanical applications.

As will become apparent, certain embodiments of the present invention involve components that are implemented with (e.g., operably configured to driven by, connected to, engaged to, etc.) a servo motor (a.k.a. simply a "servo"). Generally speaking, a servo is a device having a rotatable output shaft. The output shaft can typically be positioned to specific angular positions in accordance with a coded signal received by the servo. It is common that a particular angular position will be maintained as long as a corresponding coded signal exists on an input line. If the coded signal changes, the angular position of the shaft will change accordingly. Control circuits and a potentiometer are typically included within the servo motor casing and are functionally connected to the output shaft. Through the potentiometer (e.g., a variable resistor), the control circuitry is able to monitor the angle of the output shaft. If the shaft is at the correct angle, the motor actuates no further changes. If the shaft is not at the correct angle, the motor is actuated in an appropriate direction until the angle is correct.

There are different types of servo motors that include output shafts having varying rotational and torque capabilities. For example, the rotational and/or torque capability of an industrial servo is typically less restricted than that of a hobby servo. That being said, hobby servos are generally available commercially at a cost that is much less than that associated with industrial servos.

Because hobby servos are relatively small and inexpensive, they are popular within the hobby-mechanical industry for applications such as, but by no means limited to, hobby robotic applications and radio-controlled models (cars, planes, boats, etc.). One example of a hobby servo is the Futaba S-148 available from Futaba Corporation of America located in Schaumburg, Ill. Another example is the HS-475HB.

SUMMARY

Hobby mechanical kits are provided. Kits illustratively include a hobby servo motor having a rotatable output shaft. The output shaft has gear teeth distributed around an outer diameter of the shaft. Certain embodiments of kits also include a hobby servo horn and a channel. The hobby servo horn has an inner diameter with gear teeth that correspond to the hobby servo output shaft gear teeth. The channel has a first panel, a second panel, and a third panel. The hobby servo horn and one of the panels of the channel include a star-shaped connection point.

BRIEF DESCRIPTION OF THE DRAWINGS

FIG. 2-1 is a perspective view of a hobby servo motor.

FIG. 2-2 is a side view of the hobby servo motor.

FIG. 2-3 is a perspective view of the hobby servo motor showing an internal potentiometer and control circuit removed from the hobby servo housing.

FIG. 3-1 is a perspective view of a servo mounting bracket.

FIG. 3-2 is a perspective of the servo mounting bracket with an attached hobby servo motor.

FIG. 4-1 is a top view of a servo horn attachment mechanism.

FIG. 4-2 is a bottom view of the servo horn attachment mechanism.

FIG. 4-3 is a perspective view of the servo horn attached to a hobby servo motor output shaft.

FIG. 4-4 is a perspective view of a hobby servo mounting bracket attached to a hobby servo output shaft utilizing a servo horn.

FIG. 5-1 is a perspective view of a tube clamping hub.

FIG. 5-2 is a top view of the tube clamping hub.

FIG. 5-3 is a bottom view of the tube clamping hub.

FIGS. 8-1, 8-2, and 8-3 are perspective views of channel pieces.

FIG. 10-1 is a perspective view of an angled bracket.

FIG. 10-2 is a perspective view of a support plate.

FIG. 10-3 is a perspective view of a flat bracket.

FIGS. 11-1 and 11-2 are perspective views of angle bars.

FIG. 11-3 is a perspective view of a flat bar.

FIG. 12-1 is a top down view of a wheel that includes a modular star-shaped connection scheme.

FIG. 12-2 is a perspective view of the wheel connected to a hobby servo motor.

FIG. 13-1 is a perspective view of a two servo motor mounting bracket.

FIG. 13-2 is front perspective view of the two servo motor mounting bracket with two servos attached.

FIG. 13-3 is rear perspective view of the two servo motor mounting bracket with two servos attached.

FIG. 14-1 is a top down view of a gear that includes a modular star-shaped connection scheme.

FIG. 14-2 is a perspective view of the gear attached to a hobby servo motor utilizing a horn.

FIGS. 15-1 and 15-2 are perspective views of a channel rotatably connected to a bracket to form a hinge.

FIG. 16-1 is a diagram of a polar coordinate system.

FIG. 16-2 is a star-shaped connection point.

DETAILED DESCRIPTION

I. Overview of Kits and Components

Embodiments of the present invention generally pertain to various kits and components that are assembled in virtually unlimited combinations to form virtually unlimited hobby mechanical applications. Some of the components are structural in nature, others are mechanical devices, and still others involve implementation of motor devices. Embodiments of the present invention also pertain to a modular scheme for configuring the components relative to each other and/or attaching the components to each other.

In one embodiment, the components shown and described herein are sold together in a kit. Embodiments of kits include any combination of components. Further, the components are illustratively sold in kits that include more than one unit of a given component. It is also contemplated that any of the components are sold individually, for example, to supplement a previously purchased collection of the components.

Figure 1:
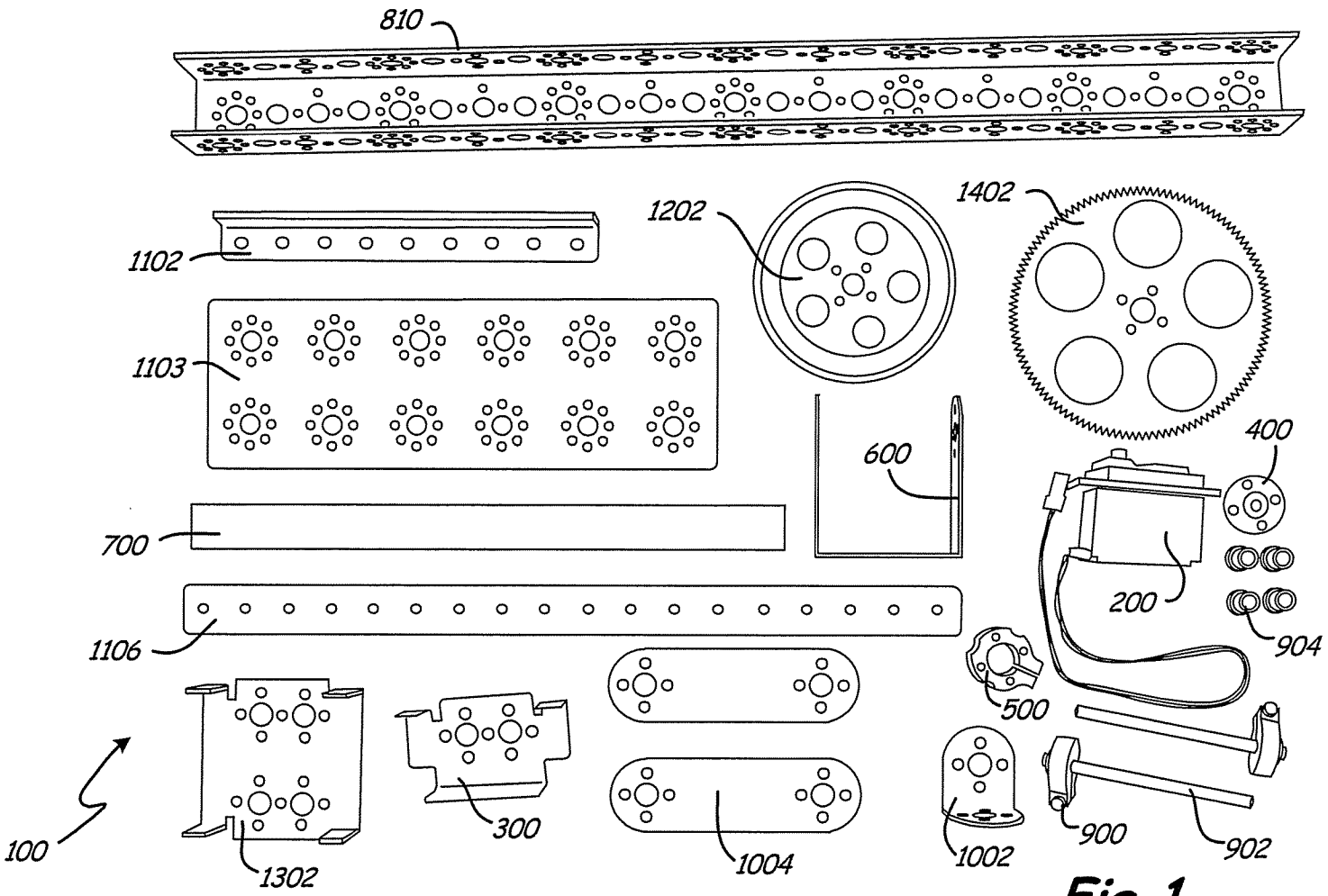
FIG. 1 is a top down view of a kit.

FIG. 1 is one embodiment of a kit 100. Kit 100 illustratively includes a hobby servo motor 200 and a variety of structural and mechanical components. As will be described in greater detail later, the components in kit 100 include features that allow for the components to be connected to or attached to each other, allowing for a variety of different assemblies of components. Those skilled in the art will appreciate that kit 100 is but one example of a kit. There, of course, are many variations. It is also to be understood that individual components, including additional instances of the illustrated components and/or components other than those illustrated are optionally added to embodiments of kits. Of course, smaller or larger quantities than the illustrated quantities are also included in embodiments.

In certain embodiments of kits, some standard, well-known components are included. Some of these are illustratively off-the-shelf type components such as screws, bolts, and washers. However, many of the components shown in FIG. 1 are unique and are described in detail below.

In one embodiment, some or all of the components in a kit are made from one or more metals such as, but not limited to, aluminum or stainless steel. In another embodiment, one or more components or one or more parts of a component are made from non-metal materials. In yet another embodiment, a combination of metal and non-metal materials is used.

As will become apparent, many of the parts incorporate a modular attachment scheme. In particular, the larger, more structural components incorporate a through hole scheme with carefully selected dimensions and placement such that there is a consistency from one part to another. This enables components and hardware (e.g. a bushing, a shaft, etc.) to be inserted/engaged consistently from one part to the next. In other words, the connection scheme is very modular. Thus, there is a large number of different combinations in which the various parts can be assembled. As additional pieces are added to a kit, the number of possible combinations increases.

In an embodiment, one or more hobby servo motors is included in a kit. Before proceeding, it is worthwhile to first discuss some of the features of hobby servo motors.

II. Hobby Servo Motors

Figures 1, 2:
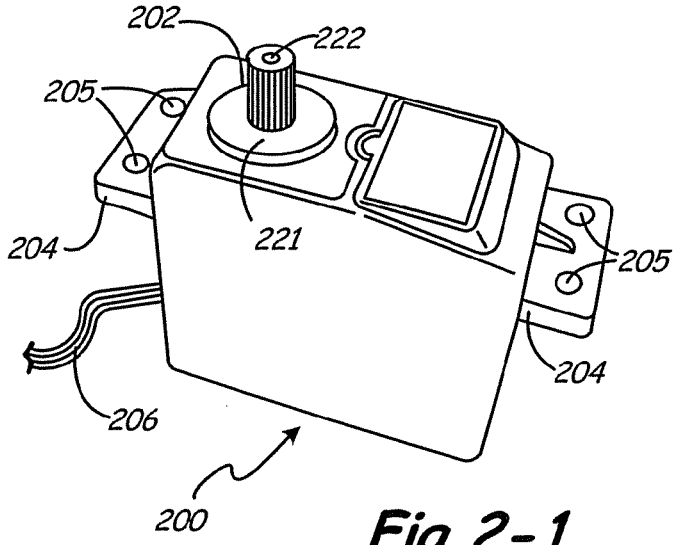
Figure 2:
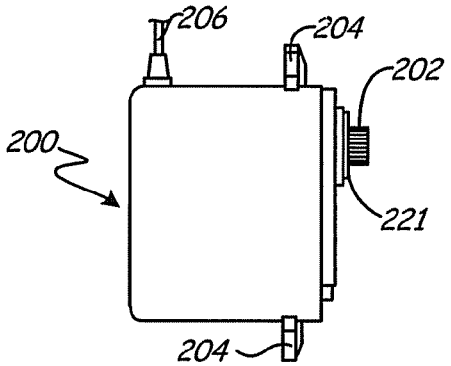

FIG. 2-1 is a perspective view of a hobby servo motor 200 and FIG. 2-2 is a side view of hobby servo motor 200. Servo 200 includes attachment flanges 204. Flanges 204 optionally include apertures 205 formed therein for receiving an attachment mechanism (e.g., a screw, bolt, etc). The attachment mechanism is illustratively utilized to secure servo 200 within an operative environment. Servo 200 also includes an electrical connection 206 that enables the servo to receive electrical power and/or control signals.

Servo 200 includes a rotatable output shaft 202 also known as a servo spline or a servo splined output shaft. Shaft 202 optionally has an outer perimeter or periphery that has splines or teeth. It is common for shaft 202 to have a 23, 24 or 25 tooth configuration.

Output shaft 202 is positioned to specific angular positions in accordance with a coded input signal received by the servo. It is common that a particular angular position will be maintained as long as a corresponding coded signal exists on an input line. If the coded signal changes, the angular position of the servo output shaft 202 will change accordingly.

In an embodiment, output shaft 202 includes a threaded orifice 222. Threaded orifice 222 extends into splined output shaft 202 from its distal end. As will be described later, orifice 222 is illustratively used to secure an item such as a gear, horn, or other attachment mechanism to shaft 202. Servo 200 further includes a planar or relatively planar surface 221 that surrounds shaft 202. In accordance with one aspect of the present disclosure, gears, horn, and attachment mechanisms that are attached to, rotatably coupled to, or functionally engaged to shaft 202 also include a planar or relatively planar surface. In such an embodiment, a surface of the item being attached and surface 221 are engaged to one another in a relatively flush relationship.

Figures 2, 3:
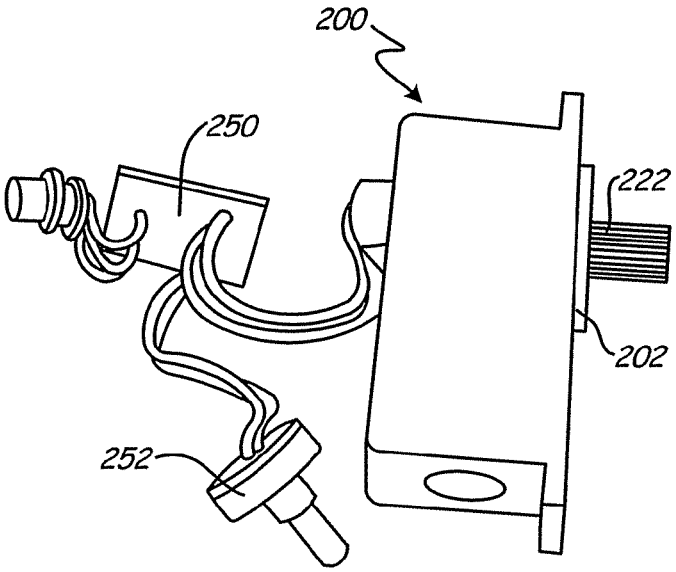
Figures 1, 3:
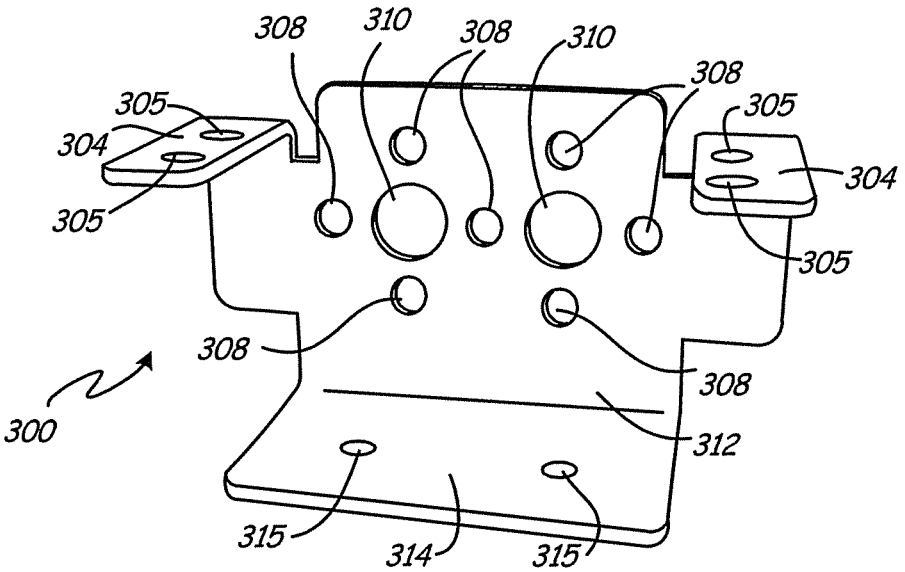
Figures 2, 3:
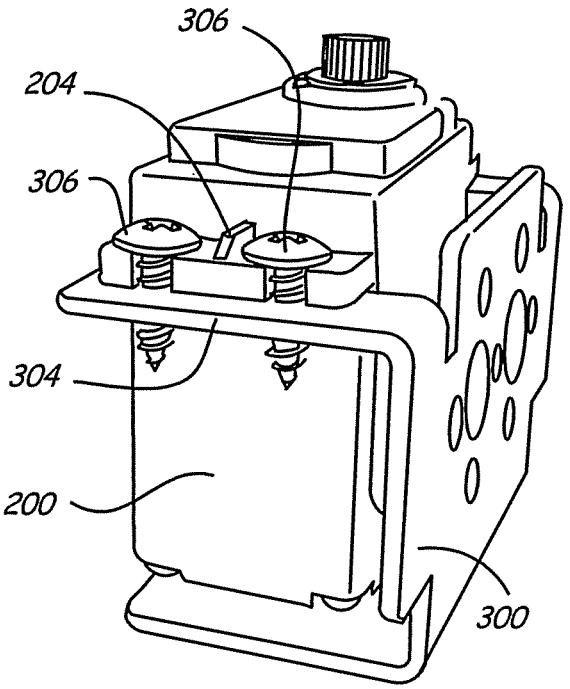

FIG. 2-3 is a perspective view of hobby servo motor 200 showing an internal potentiometer 252 and control circuit 250 removed from the hobby servo housing or casing. Control circuit or circuits such as circuit 250 and an internal potentiometer such as potentiometer 252 are commonly included within the housing or casing of a hobby servo motor. The control circuitry and potentiometer are functionally connected to the hobby servo motor rotatable output shaft. Through the potentiometer (e.g., a variable resistor), the control circuitry is able to monitor the angle of the output shaft. If the shaft is at the correct angle, the motor actuates no further changes. If the shaft is not at the correct angle, the motor is actuated in an appropriate direction until the angle is correct.

Rotation of a servo output shaft such as shaft 202 is typically limited to around 180°. In most cases, rotation is limited at least because of an internal mechanical stop. It is also common that servo output shaft 202 is capable of producing a relatively limited amount of torque power. The torque and rotational limitations of a hobby servo are adequate for many applications; however, some applications require a servo having torque power and/or a rotational capacity that is beyond the capability of a typical hobby servo. Increased torque power and/or rotational capacity enable greater mechanical flexibility.

In accordance with one embodiment of the present disclosure, hobby servo motors such as servo 200 are internally modified to enable a range of output shaft rotation that is greater than its "off-the-shelf" capability. For example, in accordance with one embodiment, an internal mechanical stopping mechanism, which prevents rotation past a predetermined angle, is removed from hobby servo motor to enable for continuous rotation in either direction. As a result of the modification, the rotatable output shaft of a hacked or modified servo is able to rotate beyond the range of rotation prior to the modification.

Following modification of servo 200, limitations inherent to the internal potentiometer make it a poor choice for subsequent control functionality. As previously mentioned, in a normal servo operating configuration, the servo motor rotates the servo output shaft corresponding to the coded signal received by the servo. The output shaft is rotated until the signal from the internal potentiometer of the servo, which corresponds to the angular position of the servo output shaft, matches the coded signal received by the servo. Most hobby servos contain internal potentiometers such as potentiometer 252 shown in FIG. 2-3 that are physically limited to monitoring a limited range of angles (e.g., often less than 200 degrees). Therefore, when a servo 200 is modified for extended rotation, the internal potentiometer is not the best control component for applications that require the servo shaft to rotate beyond the typical rotation limits in order to provide improved rotational capacity. The internal potentiometer is not likely to support control of a range of rotation that is even equivalent to the original rotational range of the servo output shaft.

In accordance with one aspect of the present disclosure, the internal potentiometer is disconnected and an external/auxiliary potentiometer is inserted into the control scheme to facilitate proportional control of the servo splined output shaft. In an embodiment, servo 200 utilizes the coded input signal and the signal from an external potentiometer to rotate and position the output shaft. A particular external potentiometer having any of a variety of control characteristics can be selected and implemented based on the requirements of a given application. Therefore, a potentiometer with a rotational range of substantially less than or greater than 180° can be selected and implemented as desired.

III. Illustrative Kit Components

Embodiments of kits include components other than hobby servo motors. Several illustrative components are described below.

One component illustratively included in the kit is a servo mounting bracket which, in one embodiment (not by limitation) is made of an aluminum material. FIG. 3-1 is a perspective view of a servo mounting bracket 300 by itself, and FIG. 3-2 is a perspective view of servo mounting bracket 300 with a hobby servo motor 200 mounted or attached within bracket 300.

Servo mounting bracket 300 includes two servo support/attachment flanges 304. Each flange 304 illustratively has two apertures 305. As can be seen in FIG. 3-2, flanges 304 and apertures 305 are used to attach a hobby servo motor. FIG. 3-2 shows that flanges 204 of servo 200 are attached to bracket 300 using flanges 304, apertures 305, and screws 306. Other attachment schemes other than apertures and screws are within the scope of the present disclosure. For example, adhesives, clamps, or interlocking features are illustratively included within embodiments.

Flanges 305 are illustratively connected or attached to a center or support panel or plate 312. In an embodiment, such as that shown in FIGS. 3-1 and 3-2, panel 312 and flanges 305 are connected at approximately right angles. In another embodiment, panels 312 and flanges 305 connect at acute or obtuse angles. In yet another embodiment, panel 312 and flanges 305 are connected together through a smooth curve (i.e. no sharp corners).

Center panel 312 includes a set of large connector holes or apertures 310 and a set of small connector holes or apertures 308. Holes 308 and 310 are illustratively drilled through center panel 312 such that each large hole 310 has three small holes 308 and such that a single small hole 308 is positioned between the two larger holes 310.

It should be noted that throughout this application that center holes are commonly referred to as larger holes and that holes that surround center holes are commonly referred to as smaller holes. Embodiments include center holes and surrounding holes of different relative dimensions. In one embodiment, center holes and their surrounding holes are the same size. In another embodiment, center holes are smaller than surrounding holes.

Figures 1, 4:
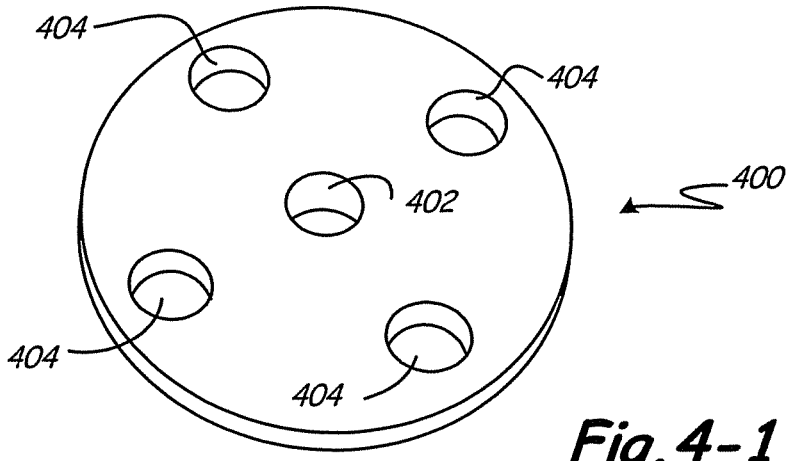
Figures 2, 4:
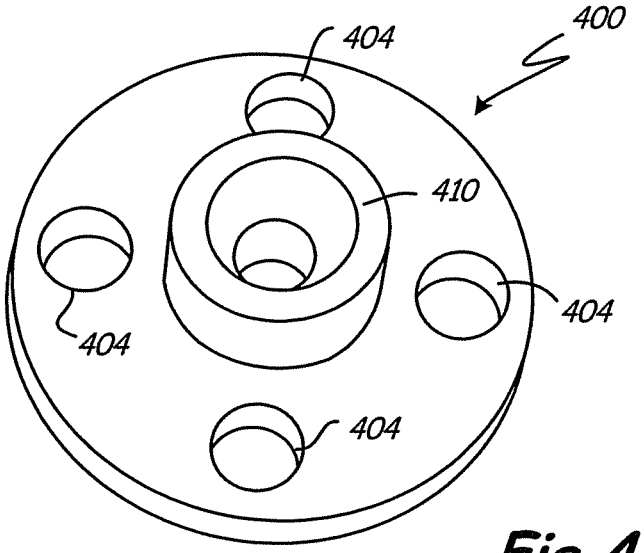
Figures 3, 4:
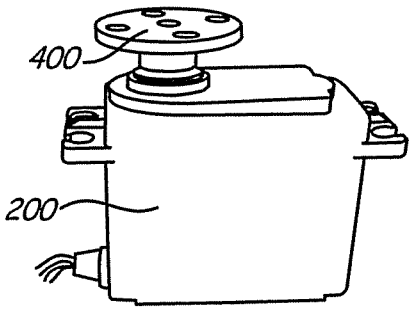
Figure 4:
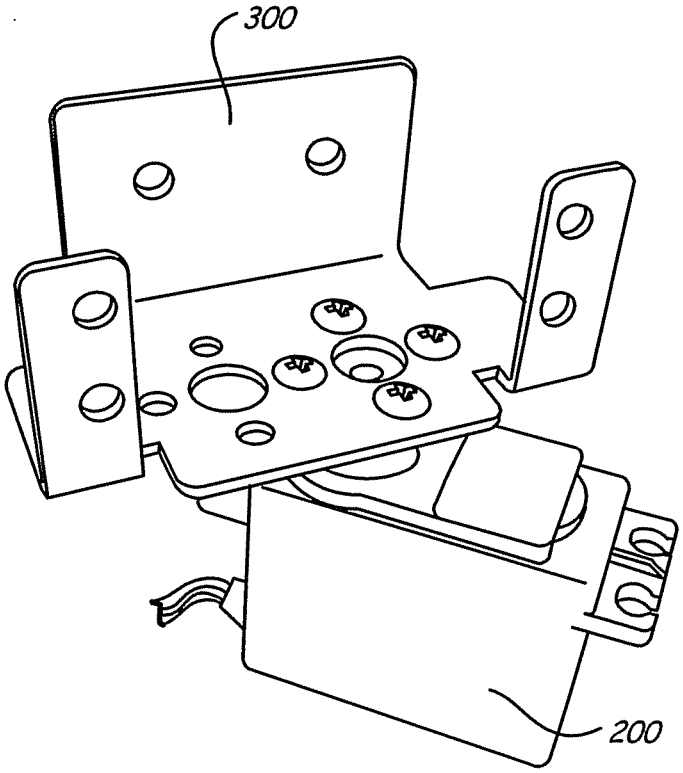

Connector holes 308 and 310 enable a variety of connections to other parts. For example, in one embodiment, a servo horn 400 (shown in FIGS. 4-1 and 4-2) includes a hole pattern that corresponds to hole sets 308 and 310. Connection mechanisms such as bolts with nuts are illustratively utilized to engage the servo horn to bracket 300 (shown in part in FIG. 4-4). In one embodiment, a connection mechanism goes through one or more of small holes 308 and large holes 310 are not utilized in the connection. As is shown in FIG. 4-3, the servo horn is adapted to be connected directly to the output shaft of a servo. Accordingly, bracket 300 is driven or rotated by a servo through the engagement of the servo horn to bracket 300.

Bracket 300 also optionally includes a bottom or lower panel or plate 314. Panel 314 optionally includes one or more apertures 315 that may illustratively be used to secure bracket 300 and any attached servos to another piece. In one embodiment, such as that shown in FIG. 3-1, panel 314 is connected or attached to center panel 312 at approximately a right angle such that panel 314 is approximately parallel to flanges 304. In another embodiment, lower panel 314 is connected or attached at an obtuse or acute angle. Yet in another embodiment, panel 314 is connected to center panel 312 through smooth curves (i.e. no sharp connection points or angles).

FIG. 4-1 is a top view of a servo horn 400, and FIG. 4-2 is a bottom view of servo horn 400. Horn 400 includes a center through hole 402 surrounded by four outer through holes 404. The four outer holes 404 support attachment to any of the many star-like attachment points associated with many components described herein (e.g., bracket 300 includes sets 308 and 310, which are examples of the star-like attachment points). Center through hole 402 of horn 400 illustratively enables an attachment mechanism (e.g., a screw) to be utilized to secure the horn to the output shaft of a hobby servo.

As is shown FIG. 4-2, horn 400 includes a protrusion 410 having an inner diameter with gear teeth configured to correspondingly engage gear teeth distributed around the outside diameter of a hobby servo output shaft. Thus, horn 400 can be secured to the output shaft, and then secured to a component with one of the star-like attachment points such that the servo will drive the horn, thereby driving the component. It is contemplated that that the gear teeth configuration of horn 400 can vary to accommodate different servo output spline configurations. FIG. 4-3 is a perspective view of horn 400 attached to or functionally engaged to a hobby servo output shaft.

FIG. 4-4 is a perspective view of a hobby servo mounting bracket 300 attached to a hobby servo output shaft using horn 400. This is, of course but one of many possible connections to bracket 300 and connections using the star schema. Another example will now be given.

Figures 1, 5:
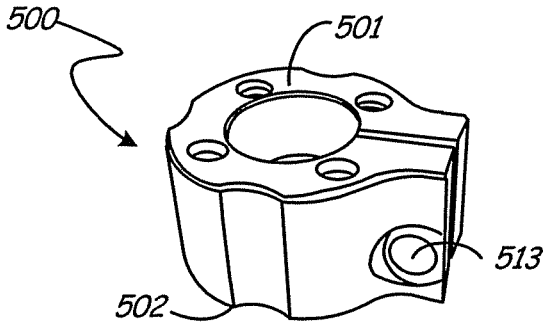
Figures 2, 5:
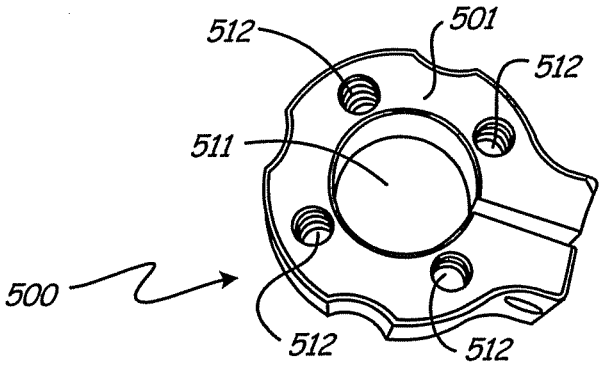
Figures 3, 5:
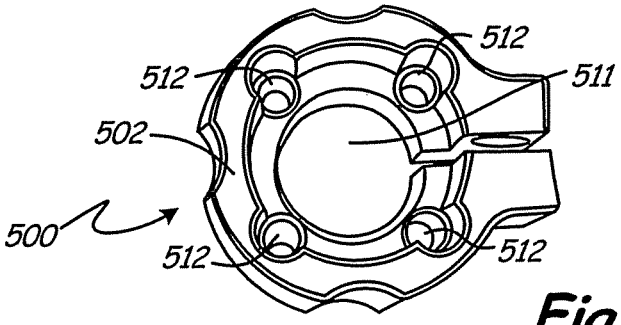

FIG. 5-1 is a perspective view of an aluminum tube clamping hub 500. FIG. 5-2 is a top view of hub 500, and FIG. 5-3 is a bottom view of hub 500. Hub 500 includes a top side or surface 501 and a bottom side or surface 502. Hub 500 also include a large center through hole or aperture 511 sized to receive an aluminum tube (described below in regard to FIG. 7 and illustratively included in a kit). Hub 500 further includes four connector holes 512 spaced around the perimeter of the larger center hole 511. Connector holes 512 are illustratively configured to support attachment (e.g., utilizing screws or bolts or etc.) of hub 500 to any part that, like bracket 300, includes a corresponding star-like connection pattern (e.g., sets 308 and 310 in bracket 300). Thus, hub 500 can be secured to bracket 300 such that an aluminum tube may extend from the bracket 300. Hub 500 includes an additional through hole 513 that extends through two flanges. A connection mechanism (e.g., a screw) is utilized to tighten the two flanges together, thereby securing a piece of tubing within hub 500.

Figure 6:
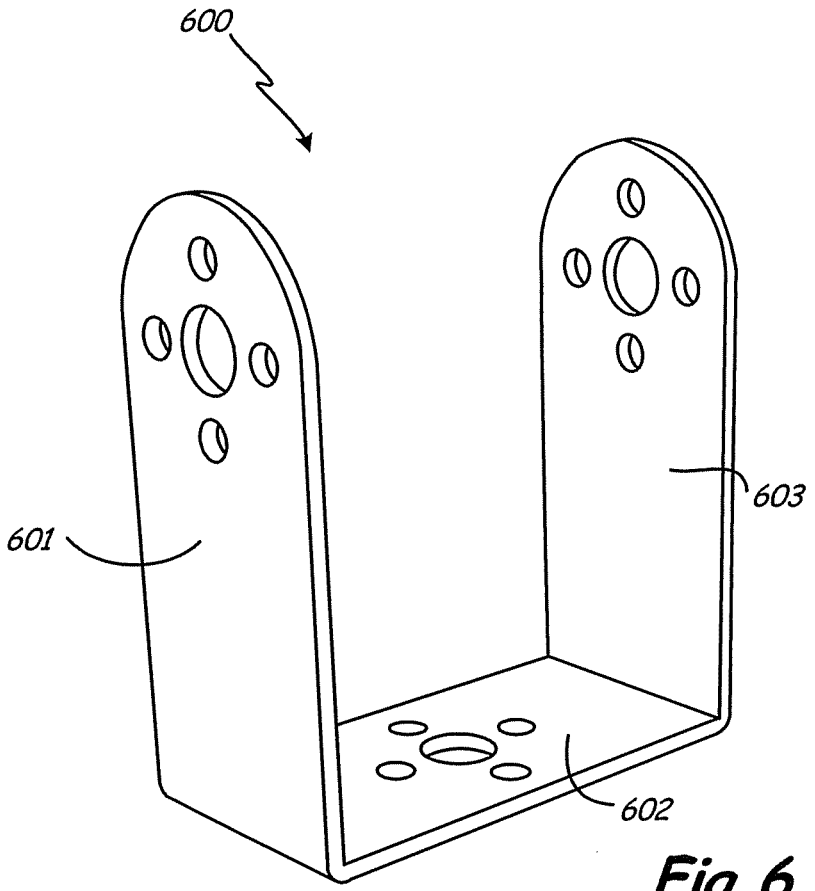
FIG. 6 is a perspective view of a servo joint bracket.

FIG. 6 is a perspective view of one example of a servo joint bracket 600 that is optionally included in an embodiment of a kit. Bracket 600 includes a first panel 601, a second panel 602, and a third panel 603. Panels 601-603 illustratively form an approximately U-shape and are connected to each other at approximately right angles. In another embodiment, the panels are connected or attached to each other at acute or obtuse angles. In yet another embodiment, the panels are connected or attached together with smooth curves such that the panels literally or more literally form a U-shape.

Servo joint bracket 600 is shown to include three instances of the star-shaped connection scheme. It is worth digressing about these star-shaped connectors or schemes. It is to be understood that more or fewer of these connection points or schemes are optionally included in any of the components described herein. Those skilled in the art will appreciate how various components described herein are configured to support connections at these star-shaped connection points utilizing connection mechanisms (e.g., screws, bolts, nuts, etc.). These points of connection have been shown with four small holes distributed around a larger center hole. It is to be understood that any number of smaller holes are illustratively spread around a larger center hole without departing from the scope of the present invention. Also, as was previously mentioned, the relative sizing of the center holes compared to the surrounding holes includes the center holes being larger, the holes being the same size, and the center holes being smaller. When two components are connected together at one of these points of connection, their corresponding through holes can be rotated relative to each other such that the two components can be connect at a variety of different angles relative to each other. More small holes around the center hole means that a broader range of angles are available (i.e., the angle between two components being connected together).

In one embodiment, with regard to the star-shaped points of connection, the size of the center hole is selected to accommodate a particular shaft and/or bushings. The size of the smaller holes around the center hole are illustratively selected to support a particular mechanical connection scheme (e.g., to support nuts, bolts, screws, etc. that enable one component to be secured to another component at the point of the points of connection).

Bracket 600 includes three of the star-shaped points of connection. Accordingly, there are three possible ways in which bracket 600 is illustratively attached to the output shaft of a servo by way of a servo horn 400. This is but one of many examples of how bracket 600 is combined with other components described herein. In another embodiment, bracket 600 includes only one or two points of connection.

Figure 7:
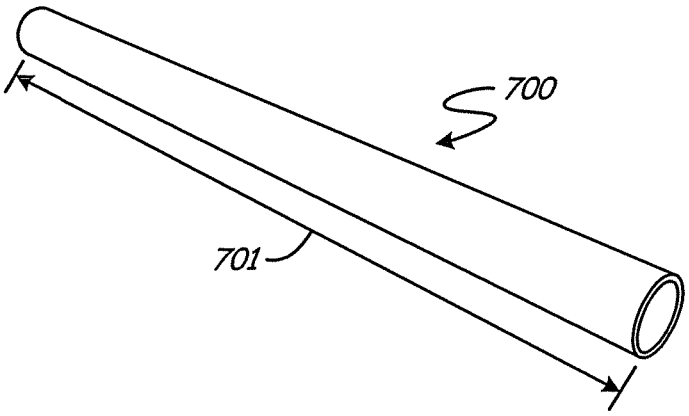
FIG. 7 is a perspective view of a piece of tubing.

FIG. 7 is a perspective view of an example of a piece of tubing 700 that is included in certain embodiments of kits. Tubing 700 is illustratively but not necessarily constructed of an aluminum material. FIG. 7 shows that tubing 700 is a hollow tube that has an inner diameter and an outer diameter. Embodiments of tubes include any inner and outer diameters. In an embodiment, a solid tube is used and thus there is no inner diameter. Embodiments of tubing 700 having varying lengths 701. Tubing 700 is illustratively used with a clamp such as clamp 500 which has been previously described.

Figures 1, 8:
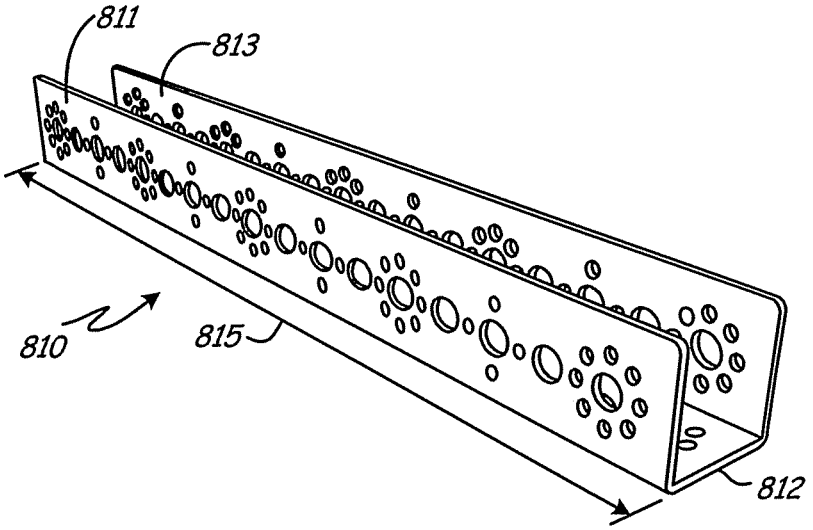
Figures 2, 8:
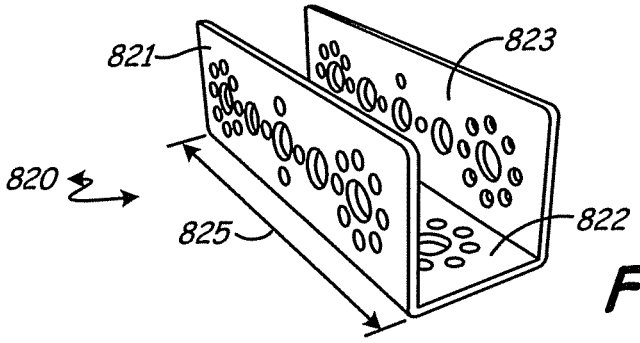
Figures 3, 8:
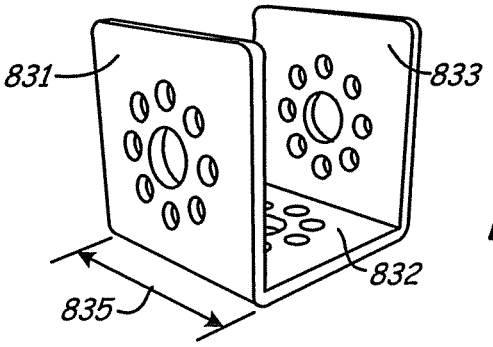

FIG. 8-1 is a perspective view of a channel piece 810. FIG. 8-2 is a perspective view of a channel piece 820, and FIG. 8-3 is a perspective view of a channel 830. Embodiments of kits include one or more channel pieces of various lengths. Each channel has a first side or panel (811, 821, 831), a second side or panel (812, 822, 832), a third side or panel (813, 823, 833), and a length (815, 825, 835). The sides or panels illustratively form an approximate U-shape and are joined together at approximately right angles. In another embodiment, the panels are connected or attached to each other at acute or obtuse angles. In yet another embodiment, the panels are connected or attached together with smooth curves such that the panels literally or more literally form a U-shape. Embodiments of channels include any size, length, and configuration. Channel pieces are illustratively but not necessarily constructed of an aluminum material.

In certain embodiments, such as those shown in FIGS. 8-1, 8-2, and 8-3, channel pieces include multiple instances of the star-shaped connection schema on each of the three sides or panels. In other certain embodiments, only one or two panels include star-shaped schema.

As is shown in the figures, not all instances of the connection schema need have the same number of "satellite" smaller connection holes around the larger center hole. As is also shown, the larger center holes illustratively share at least one satellite hole in terms of their overall configuration. The channel shown in FIG. 8-1 includes larger center holes with either eight, two, or four satellite holes. In one embodiment, the schemas overlap such that a single satellite hole is always shared from one connection schema to the next. Those skilled in the art will appreciate the myriad of different ways that channel pieces can be connected to other kit components. The star-shaped connection schema provides many alternatives in terms of the relative angles at which two components can be connected to one another, particular when the shaft is being connected to another component at a point of its own star shaped schema.

In one embodiment, two components having star-shaped schemas are pressed together such that one or more of their satellite holes align with one another. Then, a connection device (e.g., a bolt) can be pushed through the aligned satellite holes. A nut can then be secured to the connection device so as to secure the two components to one another. If one satellite hole is utilized, the components will rotate relative to each other. If more than one satellite holes is utilized (i.e., two nut-and-bolt connections), the pieces will be locked in place. Again, the angle at which one component can be secured relative to the other is highly selectable.

Figure 9:
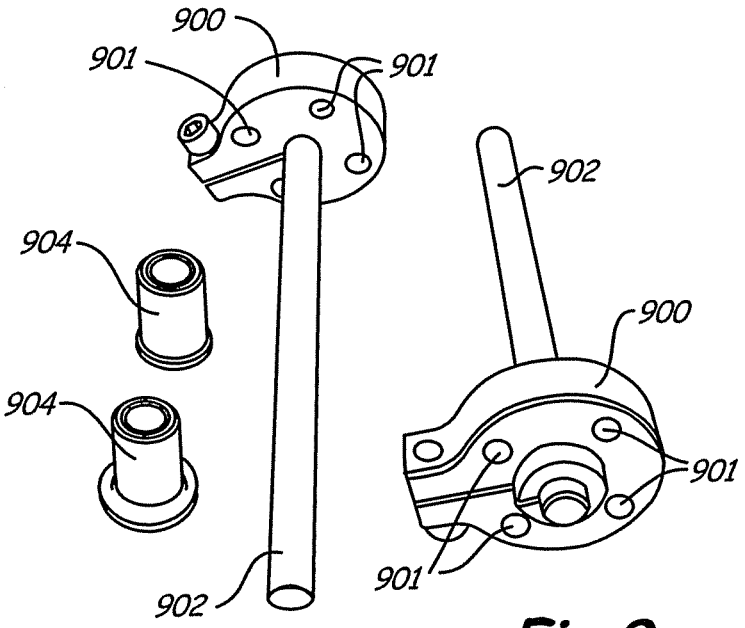
FIG. 9 is a perspective view of clamping mechanisms, shafts, and bushings.

Another series of components that are optionally included in a kit is shown in FIG. 9. FIG. 9 shows a clamping mechanism 900 that is similar to the tube clamping hub mount 500 described above. Notably, mechanism 900 includes the four hole pattern 901 that enables it to interface with and/or connect to any component that incorporates an instance of the star-shaped connection schema. Mechanism 900 is different than mount 500 in that it is illustratively configured to secure to a shaft 902 rather than a piece of tubing. Bushings 904 are configured to slide over shaft 902 and optionally fit within a center hole of a star schema.

Those skilled in the art will appreciate that the mechanisms shown in FIG. 9 can be incorporated with other kit parts in many different ways. For example, one can imagine combining with a piece of channel 810 by sliding shaft 902 through two opposing larger center holes associated with two star-shape connection schemes. Any one or more of the four connection holes 901 of hub 900 can then be secured to satellite holes associated with the star-shaped scheme of channel piece 810, or hub 900 could be left to rotate. Bushings 904 are illustratively provided because the diameter of the center holes of the star-shaped scheme are illustratively larger than the diameter of shaft 902. Bushings 901 are illustratively a closer match to the diameter of the center holes. One can also imagine that another mechanism (e.g., another hub 900, a wheel, another channel 820, a servo mount 300, or any other component that is suitable for connection, for example, any component incorporating an instance of the star-shaped scheme) can be attached to the end of shaft 902 opposite hub 900.

By now, the versatility of the star-shaped connection scheme should be apparent. Those skilled in the art will appreciate that such a connection scheme can be added to a structural piece of any shape or size, and then that modified piece can be added to the kit. Examples of additional structural pieces incorporating the star-shaped connection schema are shown in FIGS. 10-1, 10-2, and 10-3. The components shown in the figures are illustratively included in a kit.

Figures 1, 10:
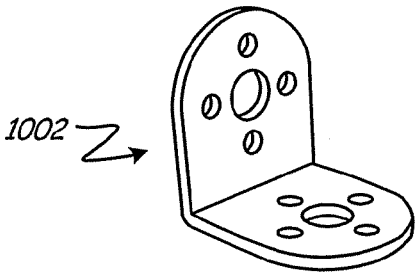
Figures 2, 10:
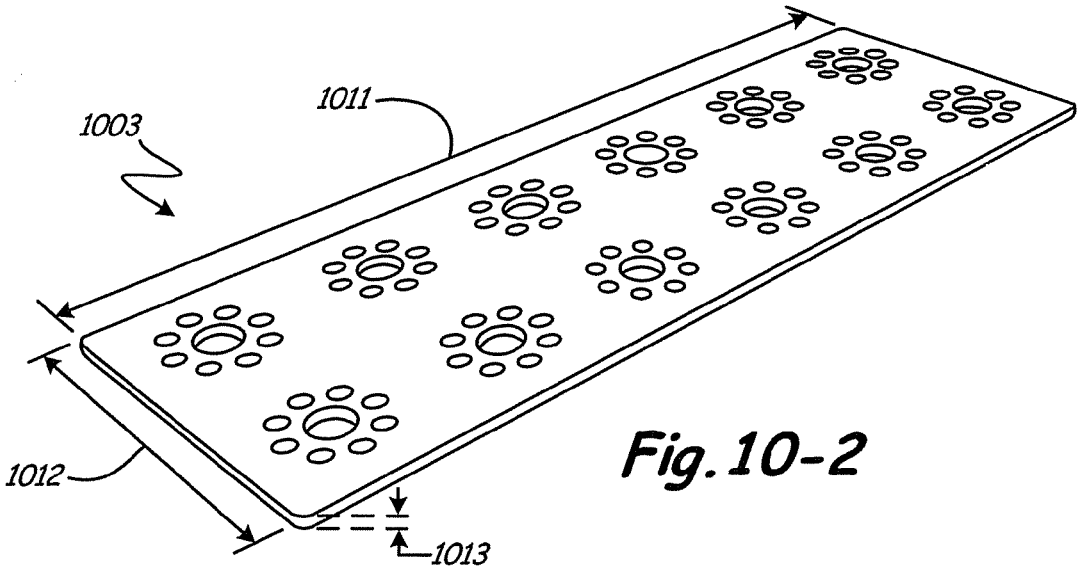
Figures 3, 10:
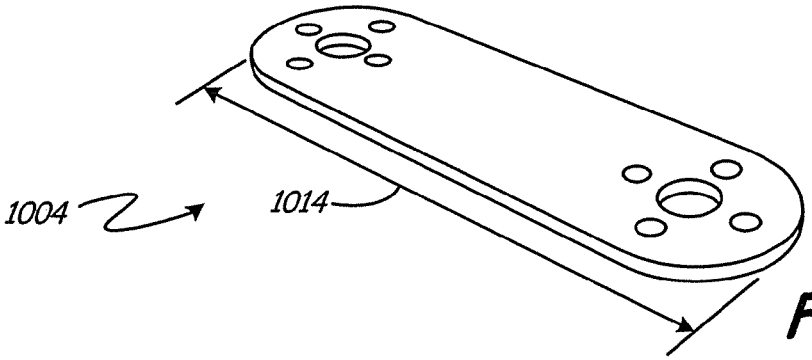

FIG. 10-1 is a perspective view of an angled bracket 1002. Bracket 1002 includes two panels or sides that are illustratively connected together at approximately a right angle. In an embodiment, the two panels or sides are connected at acute or obtuse angles. FIG. 10-1 show a star schema included on both panels of the bracket. In an embodiment, a star schema is only included on one of the two sides or panels.

FIG. 10-2 is a perspective view of a flat or approximately flat plate or support panel 1003. Panel 1003 has a length 1011, a width 1012, and a thickness 1013. Embodiments of panel 1003 include any length 1011 such that from one to any number of star schemas is included along the length of the part (FIG. 10-2 shows six star schemas along the length). Embodiments of panel 1003 also include any width 1012 such that from one to any number of star schemas is included along the width of the part (FIG. 10-2 shows two star schemas along the width). Finally, thickness 1013 is illustratively uniform or approximately uniform throughout the panel (i.e. uniform across the length and the width). Embodiments however include any type of thickness.

FIG. 10-3 is a perspective view of a flat bracket 1004. Bracket 1004 includes a length 1014. Embodiments include any length and any number of star schema. It should be noted that brackets 1002 and 1004 are shown with rounded edges or ends. In an embodiment, the edges or ends may be squared, triangle shaped, or shaped in any other fashion.

One skilled in the art will appreciate that the star-shaped attachment schema of pieces 1002, 1003, and 1004 support modularity with the other pieces. For example, the components of FIG. 9 can be connected to components in FIGS. 10-1, 10-2, and 10-3 in a manner similar to the described connection to a piece of channel 810.

All this is not to say that all pieces in a given kit must include the star-shaped attachment scheme. In one embodiment, some components are provided with connection holes spaced similarly to the "satellite" holes but not necessarily positioned around a larger center hole. The types of components are easily attached (e.g., utilizing a connection mechanism such as a screw, a nut-and-bolt combination, etc.) to each other or to any point of a star-shaped attachment scheme. By keeping the spacing consistent, there is a myriad of possibilities for connecting a simpler piece to a star-shaped connection piece. Depending upon how many satellite holes are included in the star-shaped connection scheme, there are many different angles at which a simpler piece can be attached at the point of the star-shaped connection scheme. The simpler piece can even cross multiple star-shaped connection schemes and be connection to satellite holes associated with different instances of the scheme.

Figures 1, 11:
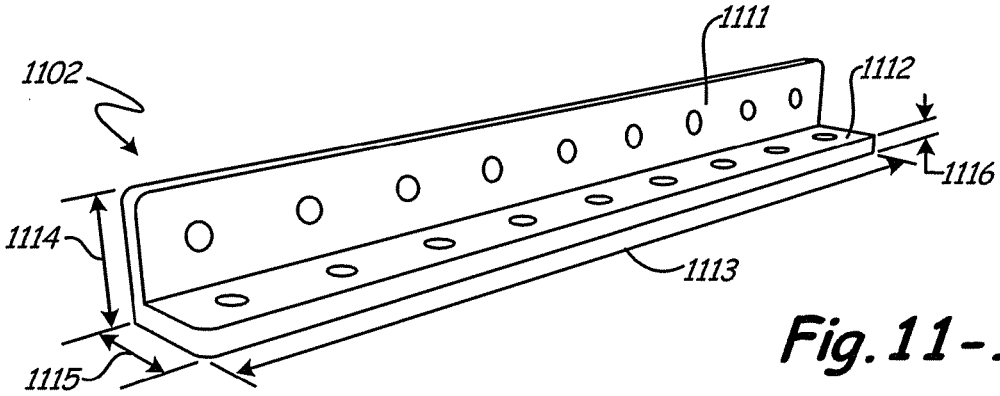
Figures 2, 11:
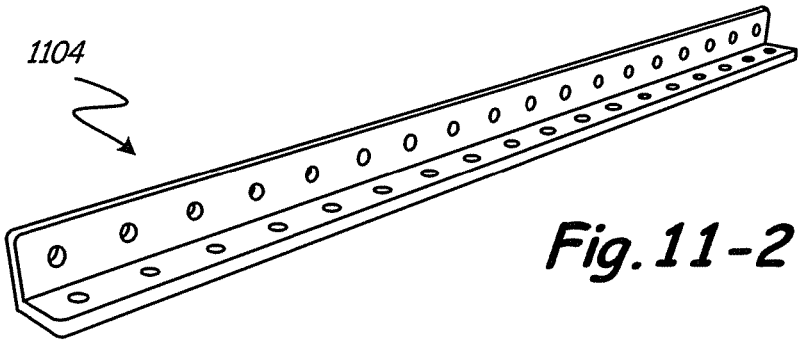
Figures 3, 11:
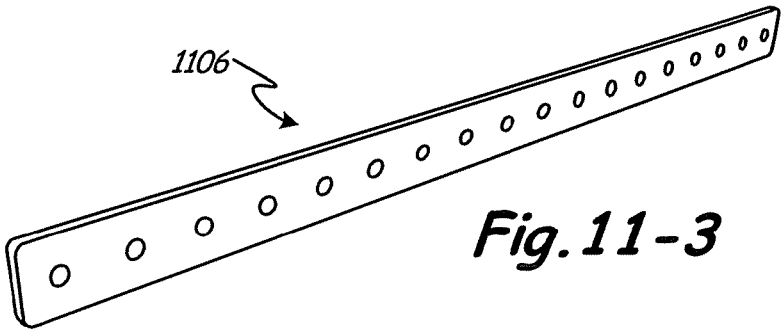

Examples, not by limitation, of such simpler pieces are shown in FIGS. 11-1, 11-2, and 11-3. FIG. 11-1 is a perspective view of an angle bar 1102. FIG. 11-2 is a perspective view of an angle bar 1104, and FIG. 11-3 is a perspective view of a flat bar 1106.

Angle bar 1102 has a first side or panel 1111 a second panel or side 1112. Panels 1111 and 1112 are illustratively connected together at an approximately right angle. In another embodiment, panels 1111 and 1112 are connected at an acute or an obtuse angle. Bar 1102 has a length 1113, a height 1114, a width 1115, and a thickness 1116. In an embodiment, such as that shown in FIG. 11-1, both panels 1111 and 1112 have an approximately uniform thickness throughout the panels.

FIG. 11-1 shows that each side of bar 1102 has a single row of through holes or apertures. Bar 1102 is shown to have nine holes. In an embodiment, length 1113 is illustratively shorter or longer and includes any number of holes from one to many. In an embodiment, width 1115 and height 1114 are illustratively shorter or wider and include any number of holes that are side by side. For example, FIG. 11-1 shows a 1 by 9 pattern. Embodiments illustratively include any other combination such as 2 by 9, 3 by 9, 4 by 12, etc.

FIG. 11-2 is a perspective view of a longer angle bar 1104. Bar 1104 is essentially a variation of bar 1102. Bar 1104 has a longer length than bar 1102 and has a corresponding increase in the number of through holes or apertures (i.e. each side of bar 1102 has nine apertures and each side of bar 1104 has eighteen apertures). As was previously mentioned, the length, width, and height of an angle bar is illustratively shortened or lengthened to include any number of apertures. Additionally, it is worth noting that in FIGS. 11-1 and 11-2 that each of the two sides is symmetrical. In an embodiment, each side is different from the other side or asymmetrical such that they include a different number of apertures, including one side having no apertures.

FIG. 11-3 is a perspective view of a flat bar 1106. Bar 1106 is similar to bars 1102 and 1104, however bar 1106 illustratively only has one side or panel. The height, width, length or bar 1106 are similarly shortened or lengthened to include any number of apertures.

Figures 1, 12:
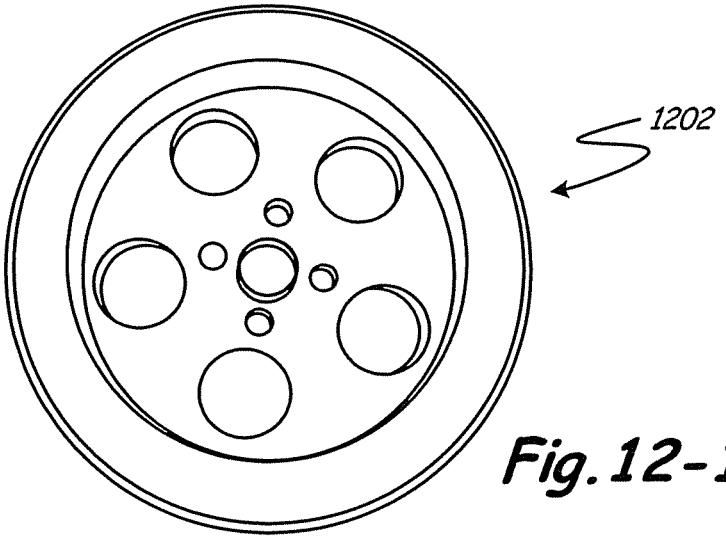
Figures 2, 12:
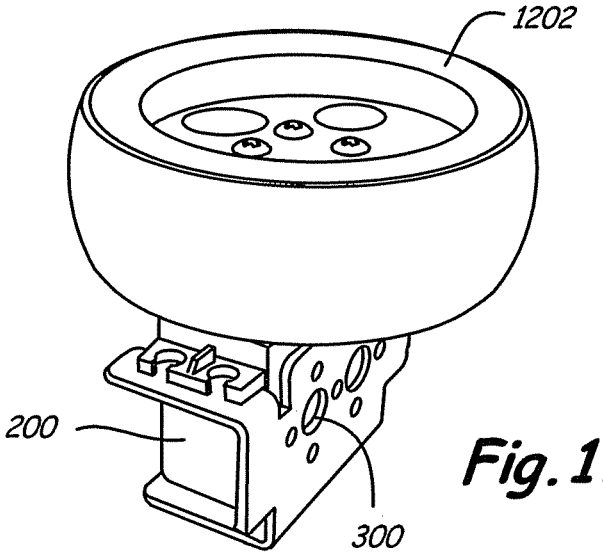

Those skilled in the art will appreciate that the described modular connection schemes can be incorporated into components that are more functional than structural in nature. For example, FIGS. 12-1 and 12-2 show examples of wheels 1202 that incorporate the star-shaped connection scheme. FIG. 12-1 is a top down view of wheel 1202, and FIG. 12-2 is a perspective view of wheel 1202 connected to a hobby servo motor 200, which is in turn connected to a servo mounting bracket 200. Embodiments of wheels such as, but not limited to wheel 1202, are illustratively included in certain embodiments of kits. These wheels are connectable to any other kit component having a similar star-shaped scheme, or to any other kit component having connection holes sized and spaced to cooperate with the "satellite" holes of the wheel's connection scheme. One skilled in the art will appreciate how wheel 1202 can be connected to a horn 400 and driven by a hobby servo. This is but one example of a potential wheel connection. One will also appreciate how some or all of the devices of FIG. 9 can be interfaced through the larger center hole of the wheel's star shaped connection scheme. In this case, it is illustratively possible to utilize the modular connection scheme and piece to connect hub 900 to a hobby servo such that the wheel can be driven by the servo (e.g., by connection the servo so as to drive the hub 900, which drives the shaft, which drives the wheel).

FIGS. 13-1, 13-2, and 13-3 show a servo mounting bracket 1302 that is similar the previously described mounting bracket 300. Bracket 1302 differs in that it is designed to support connection to two servo motors rather than just one.

Figures 1, 13:
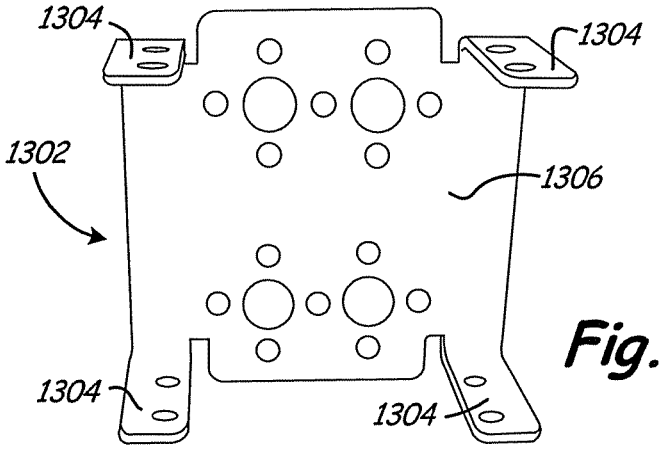
Figures 2, 13:
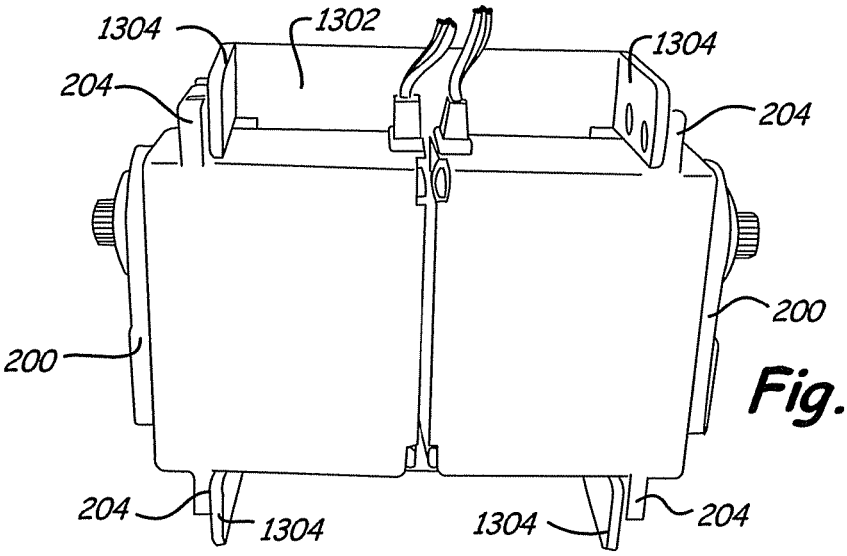
Figures 3, 13:
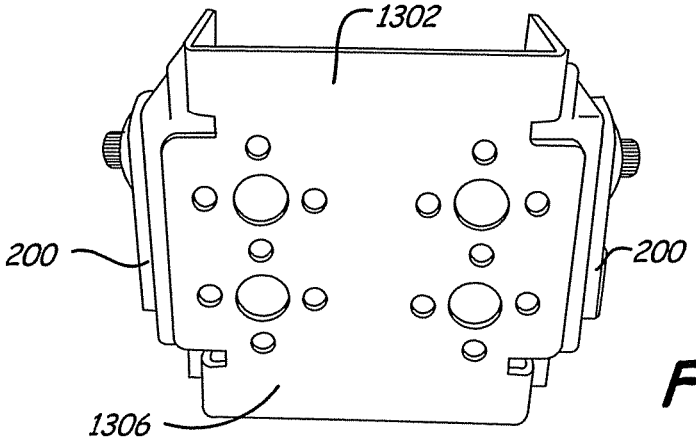

FIG. 13-1 is a perspective view of two servo motor mounting bracket 1302 by itself (i.e. without any servos attached). FIG. 13-2 is front perspective view of bracket 1302 with two servos 200 attached or mounted within the bracket, and FIG. 13-3 is a back or rear view of bracket 1302 with two servos 200 attached or mounted within the bracket.

Bracket 1302 includes four flanges 1304 that illustratively include through holes or apertures. The figures show each flange 1304 having two apertures. Embodiments include any number of apertures. As can be seen in FIGS. 13-2 and 13-3, flanges 304 are illustratively used in attaching or connecting servos to bracket 1302. The servos are illustratively attached using the servo flanges 204. Any other attachment schemes such as, but not limited to, interlocking features, adhesives, clamps, etc. are within the scope of the present disclosure.

Bracket 1302 also includes a center or back plate or panel 1306. Panel 1306 is shown as having four star schemas. Embodiments of panel 1306 include any number of star schemas including zero. As has been discussed throughout this disclosure, star schemas enable other components of the kit to connect to, functionally engage with, or attach to panel 1306.

Figures 1, 14:
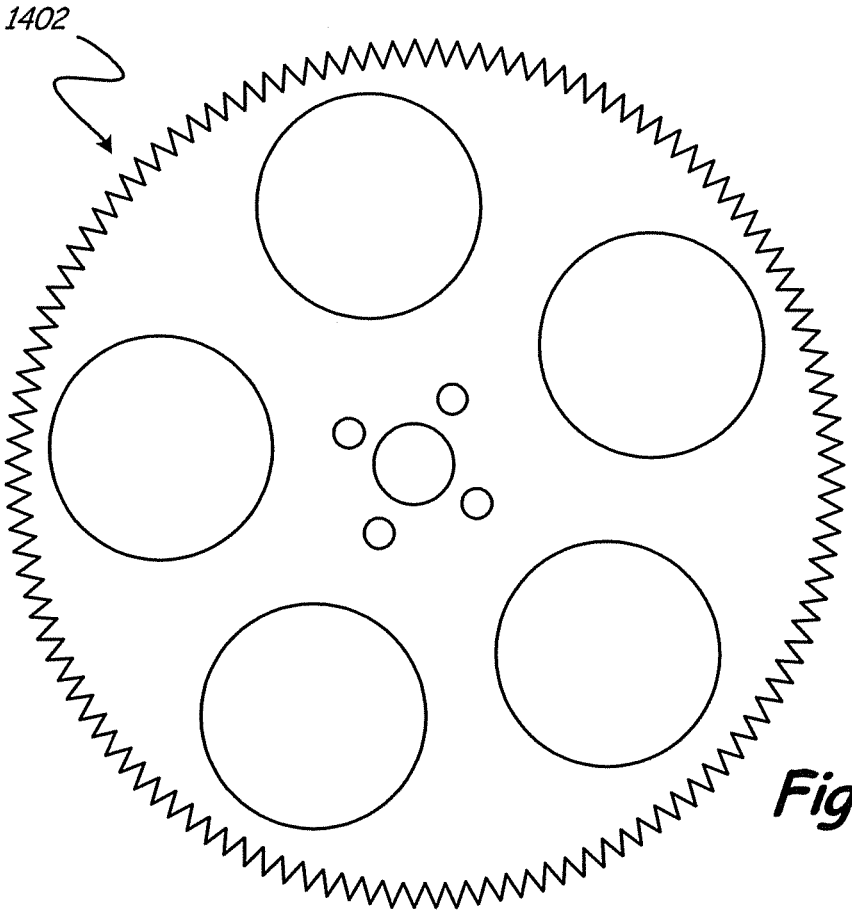
Figures 2, 14:
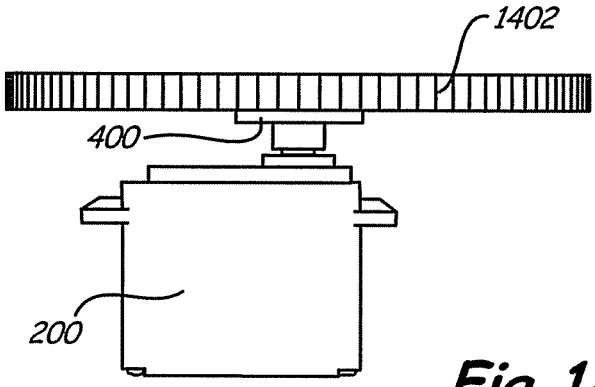

FIGS. 14-1 and 14-2 show a gear 1402 that includes the modular star-shaped connection scheme. FIG. 14-1 is a top down view of gear 1402, and FIG. 14-2 is a perspective view of gear 1402 attached to a servo 200 utilizing a horn 400. Gear 1402 is illustratively connected to other kit components in many ways. For example, FIG. 14-2 shows that gear 402 is connected to horn 400 such that the gear is driven by a hobby servo motor 200. Alternatively, gear 402 is illustratively connected to or attached to one or more components shown in FIG. 9. Gear 1402 also includes larger openings in a satellite pattern around the star-shaped connection scheme. These opening can be utilize in a variety of different ways. For example, one or more pieces of tubing 700 are illustratively inserted into one of the larger holes and rotated by the gear.

Figures 1, 15:
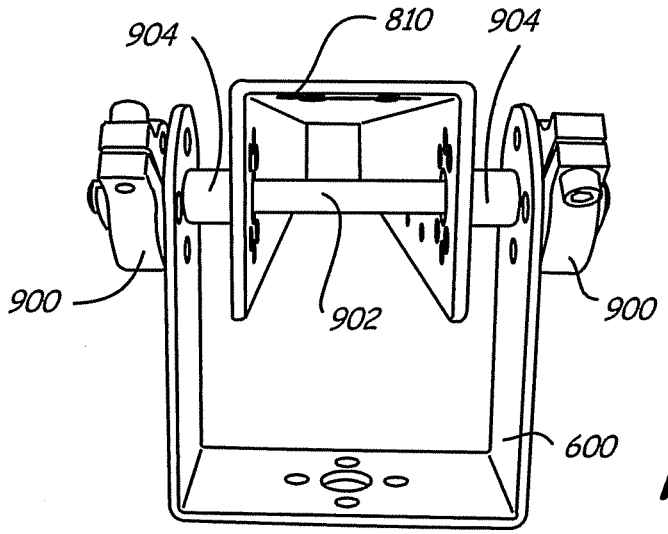
Figures 2, 15:
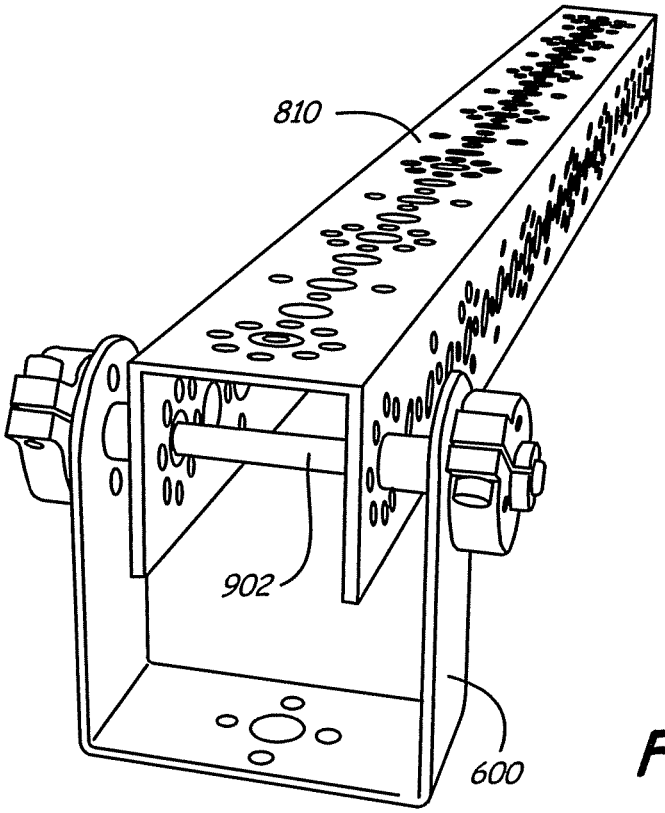

FIGS. 15-1 and 15-2 illustrate yet another potential manner in which components of embodiments of kits are attached. FIGS. 15-1 and 15-2 are perspective views of a channel 810 rotatably connected to a bracket 600 to form a hinge. The figures show that two bushings 904, two clamping mechanisms 900, and a shaft 902 are illustratively used in forming the hinge. Other attachment/connection schemes are within the scope of the present disclosure. In one embodiment, the star-shaped connectors located on the two extending arms of bracket 600 (i.e. the panels or sides oriented vertically in the figures) are aligned with two star-shaped connectors associated with a channel. Then, a shaft or tubing is inserted through the larger center hole of all four star-shaped connectors. The result is that the two components 600 and 810 are joined together in a hinged relationship. Of course, additional components can be joined to the ends of the shaft or tubing as desired. This is but another example of myriad potential configurations.

Figures 1, 16:
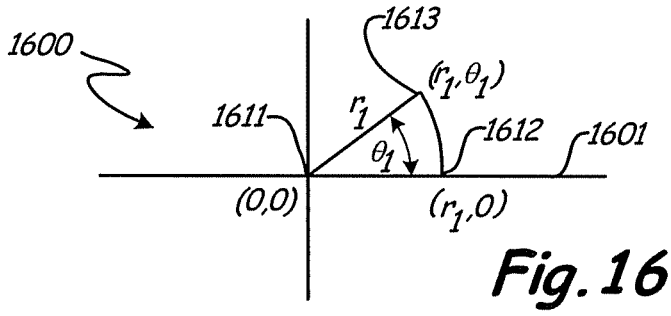
Figures 2, 16:
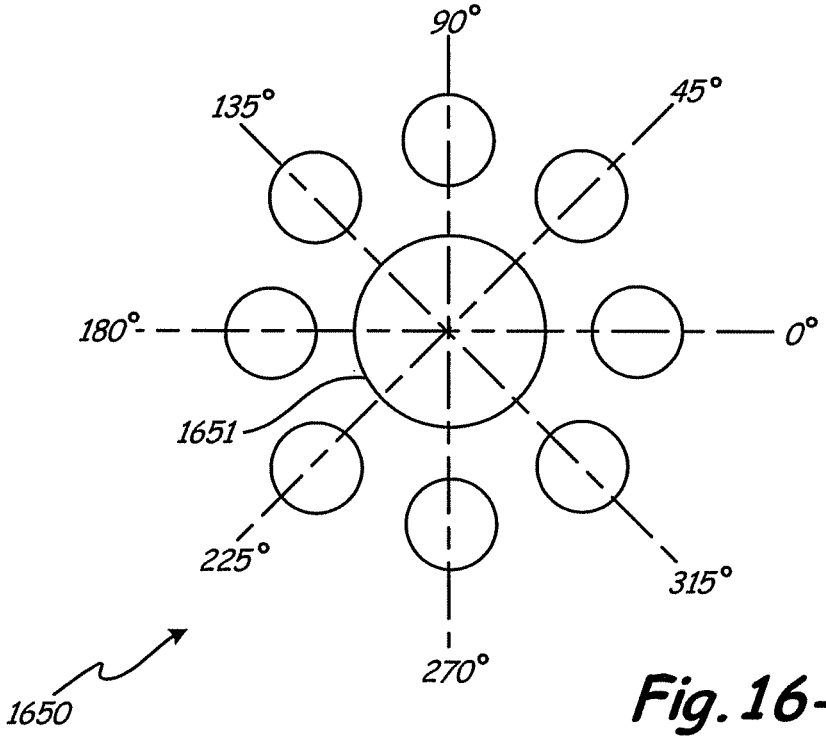

FIGS. 16-1 and 16-2 help to illustrate and describe embodiments of star-shaped connectors or schemas in more detail. Embodiments of star-shaped connectors, connections, or schemes are optionally included on all components described in this specification such as, but not limited to, horns 400, clamps 900, angle brackets 1002, flat brackets 1004, servo mounts 300 and 1302, panels 1003, channels 810/820/830, gears 1402, clamps 500, and wheels 1202.

FIG. 16-1 is a diagram of a polar coordinate system 1600. In coordinate system 1600, the location of an object is described by two coordinates (r, θ), where r is the distance from the origin of the coordinate system and θ is the anticlockwise angle from the polar axis 1601 (the polar axis corresponds to the positive x-axis in a Cartesian coordinate system). For example, in FIG. 16-1, the origin or center of coordinate system 1600 is labeled 1611 and it has the coordinates (0, 0). Point 1612 is on the polar axis and is a distance $r_1$ from the origin. Point 1612 has the coordinates ($r_1$, 0). Point 1613 is at an angle $\theta_1$ from the polar axis and at a distance $r_1$ from the origin. Point 1613 has the coordinates ($r_1$, $\theta_1$).

FIG. 16-2 is an illustrative embodiment of a star-shaped connection point or schema 1650. In an embodiment, the center of the center through hole 1651 has the polar coordinates (0, 0) (i.e. it is at the center of the coordinate system). The locations of the surrounding or peripheral holes are then illustratively characterized by a distance, r, from the origin, and an angle θ away from the polar axis. In an embodiment, such as that shown in FIG. 16-2, there are eight surrounding holes that are at an approximately equal distance from the origin, $r_1$, and are approximately angularly spaced 45° apart from each other (i.e. the coordinates of the eight surrounding circles are approximately ($r_1$, 0°), ($r_1$, 45°), ($r_1$, 90°), ($r_1$, 135°), ($r_1$, 180°), ($r_1$, 225°), ($r_1$, 270°), and ($r_1$, 315°)). In an embodiment, star-shaped connection points include any number of surrounding holes and are approximately at an equal distance from the origin, and are approximately evenly angular spaced. For example, in an embodiment having two surrounding circles, they are spaced approximately 180° apart (i.e coordinates are approximately ($r_1$, 0°) and ($r_1$, 180°). In an embodiment having three surrounding circles, they are spaced approximately 120° apart (i.e. coordinates are approximately ($r_1$, 0°), ($r_1$, 120°), and ($r_1$, 240°). In an embodiment having four surrounding circles, they are spaced approximately 90° apart. In an embodiment having five surrounding circles, they are spaced approximately 72° apart. In an embodiment having 6 surrounding circles, they are spaced approximately 60° apart. Generally speaking, in certain embodiments, the angular spacing between surrounding circles is 360° divided by the number of surrounding circles divided. For example, in an embodiment having 12 surrounding circles, they are approximately spaced 30° apart from one another.

As was described above, in an embodiment, surrounding circles are approximately at the same distance from the origin, $r_1$. In an embodiment, this distance, $r_1$, is between three eighths of an inch (⅜") and one and a half inch (1½"). Embodiments however are not limited to any particular dimensions and include any distance. Also, although in one embodiment the distance and angular spacings are approximately uniform or symmetrical, in another embodiment, different distances and spaces are included. Also, in one embodiment of a kit, at least some or all of the components include star-shaped connection points such that at least some of their surrounding holes have approximately the same relative distances and angular spacings. Such embodiments have been shown and described in previous parts of the specification and drawings such as those that describe connecting a horn to a bracket.

IV. Additional Illustrative Kit Components

Applicant hereby incorporates by reference in their entireties the following applications previously filed by Applicant: 60/391,346; 60/479,697, Ser. No. 10/872,037; 60/584,288; Ser. Nos. 11/153,800; 11/503,477; 60/964,124; 60/936,292; and 60/964,120.

Generally speaking, these previous applications describe components for enhancing the functionality of a hobby servo motor such as hobby servo motor 200 shown in FIGS. 2-1, 2-2, and 2-3. It is within the scope of the present invention to incorporate any of the components described in these applications into a kit that includes components the same or similar to those described in relation to FIGS. 1-15. It is also within the scope of the present invention to modify dimensions and/or the connection scheme, associated with any of the components described in the previous applications, to interface effectively with the modular connection scheme described in relation to FIGS. 1-15. It is within the scope of the present invention to adapt any of the components of the previous applications to better interface with the described star-shaped connection scheme.

Some of the previous applications describe devices for mounting a servo relative to an auxiliary shaft such that the servo drives the auxiliary shaft with a range of motion or torque that is greater than the standard range of motion associated with the output shaft of the servo itself. It is within the scope of the present invention to drive components of the described kit utilizing such an auxiliary shaft rather than directly utilizing the output shaft of a hobby servo. For example, a clamping mechanism such as those described in relation to FIGS. 5-1, 5-2, 5-3, and 9, provides an interface between the auxiliary shaft and any component incorporating the star-shaped connection scheme.

Another aspect of the present invention pertains to how motion is transferred from the output shaft of a hobby servo to other mechanical components of a given kit. In one embodiment, this transfer of motion is facilitated by a device that includes both 1) a splined (i.e., having gear teeth) connector configured to interface with the corresponding splined (i.e., having gear teeth) output shaft of a hobby servo; and 2) a set of one or more connector holes configured to facilitate connection (e.g., utilizing a connection device such as a screw, a nut/bolt combination, etc.) to one or more corresponding satellite holes associated with an instance of the star-shaped connection scheme. In one embodiment, the second part of this equation is a set of four holes spaced and configured to simultaneously align with four satellite holes associated with an instance of the star-shaped connection scheme. In another embodiment, the second part of this equation is a set of only two holes spaced and configured to simultaneously align with two satellite holes associated with an instance of the star-shaped connection scheme. Of course, one, three or more than four holes are also included in embodiments.

It should be noted that a component (e.g., a gear, a horn, a sprocket, a belt driving mechanism, etc.) having a splined connector configured to interface with the corresponding splined output shaft of a hobby servo need not necessarily include the described set of connector holes. If it does not have such connector holes, it could just as easily be configured to transfer its motion to another component (e.g., a gear, a horn, a sprocket, a belt driving mechanism, etc.) that does have such connector holes. There might even be one or more intermediate mechanical devices that transfer motion from the device directly connected to the servo output shaft to the device that is ultimately configured to interconnect with the star-shaped attachment schema.

In another embodiment, the motion of the servo output shaft first gets translated to an auxiliary shaft, for example utilizing any of the belt, gear, or sprocket transfer configurations shown in the prior applications that are incorporated by reference. Kit components are then connected to the auxiliary shaft. For example, a clamping hub (e.g., the same or similar to hubs shown in FIGS. 5-1, 5-2, 5-3, and 9) is illustratively secured around the auxiliary shaft (e.g., the tightening screw is engaged to being the flanges into a tightened engagement around the shaft). The hub illustratively also includes a set of one or more connector holes configured to facilitate connection (e.g., utilizing a connection device such as a screw, a nut/bolt combination, etc.) to one or more corresponding satellite holes associated with an instance of the star-shaped connection scheme. In one embodiment, the hub includes a set of four holes spaced and configured to simultaneously align with four satellite holes associated with an instance of the star-shaped connection scheme. In one embodiment, the hub includes a set of only two holes spaced and configured to simultaneously align with two satellite holes associated with an instance of the star-shaped connection scheme. Of course, one, three or more than four holes are also conceived of alternatives.

In one embodiment, in a given mechanical application, the auxiliary shaft is inserted through one or more larger center holes associated with one or more instances of the star-shaped connection schema. Similar to the configurations described in relation to FIGS. 9, 15-1, and 15-2, bushings are optionally utilized to tighten up the fit around the shaft.

The previous applications incorporated by reference also show embodiments wherein a shaft extension is directly or indirectly connected to the output shaft of a hobby servo such that the shaft extension is essentially in line with (e.g., shares a common center axis with) the hobby servo output shaft. The servo output shaft directly or indirectly drives the shaft extension. Kit components can just as easily be attached to such a shaft extension as they were described as being attached to an auxiliary shaft (e.g., utilizing the same or similar to hubs shown in FIGS. 5-1, 5-2, 5-3, and 9).

In one embodiment, in a given mechanical application, the shaft extension is inserted through one or more larger center holes associated with one or more instances of the star-shaped connection schema. Similar to the configurations described in relation to FIGS. 9, 15-1, and 15-2, bushings are illustratively utilized to tighten up the fit around the shaft.

V. Conclusion

Many illustrative components and variations on those components have been shown and described in the figures and in this specification, as well as in the applications incorporated by reference. Embodiments of kits are not limited to including any one specific component or quantities of a component. Embodiments include any combination of types of components and any number of a specific type of component in a kit.

Although the present invention has been described with reference to certain embodiments, workers skilled in the art will recognize that changes may be made in form and detail without departing from the spirit and scope of the invention.

What is claimed is:

1. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures; and a third component that includes a second set of apertures, the second set of apertures having a same number of apertures as the first set of apertures, the second set of apertures having at least approximately equivalent diameters and spacings as the first set of apertures; and wherein the second component is a gear having gear teeth that surround an outer perimeter of the gear, and wherein the hobby servo motor includes an internal potentiometer.

2. The kit of claim 1 and further comprising:

a hobby servo motor mounting bracket having a center panel, a lower panel, and two flanges, the lower panel and the two flanges being approximately parallel to each other and at right angles with respect to the center panel, the two flanges including apertures configured to secure the hobby servo motor to the mounting bracket, the center panel having a third set of apertures, the third set of apertures having the same number of apertures as the first and the second sets of apertures, and the third set of apertures having at least approximately equivalent diameters and spacings as the first and the second sets of apertures; and wherein each of the apertures in the first set of satellite apertures is spaced apart from each other at a same angular distance, wherein each of the apertures in the second set of satellite apertures is spaced apart from each other at a same second angular distance that is different than the same angular distance of the first set of satellite apertures, wherein the same angular distance is defined by three hundred and sixty degrees divided by a number of the apertures in the first set of satellite apertures, wherein the same second angular distance is defined by three hundred and sixty degrees divided by a number of the apertures in the second set of satellite apertures.

3. The kit of claim 1 and further comprising:

a hobby servo motor mounting bracket that is configured to support at least two hobby servo motors, the bracket having a center panel, a first set of flanges, and a second set of flanges, the first and the second sets of flanges being approximately parallel to each other and at right angles with respect to the center panel, the first set of flanges including apertures configured to secure the hobby servo motor to the mounting bracket, the second set of flanges including apertures configured to secure a second hobby servo motor to the mounting bracket, the center panel having a third set of apertures, the third set of apertures having the same number of apertures as the first and the second sets of apertures, and the third set of apertures having at least approximately equivalent diameters and spacings as the first and the second sets of apertures; and wherein the first set of satellite apertures and the second set of satellite apertures are angularly offset from each other such that none of the apertures in the first set of satellite apertures is aligned with any of the apertures in the second set of satellite apertures in a radial direction.

4. The kit of claim 1 and further comprising:

a gear having a third set of apertures, the third set of apertures having the same number of apertures as the first and the second sets of apertures, the third set of apertures having at least approximately equivalent diameters and spacings as the first and the second sets of apertures; and wherein the gear is rotatably connected to the hobby servo motor through the hobby servo horn such that rotation of the hobby servo motor is transferred to the gear; and wherein the second set of satellite apertures includes at least one more aperture than the first set of satellite apertures.

5. The kit of claim 1 and further comprising:

a wheel having a third set of apertures, the third set of apertures having the same number of apertures as the first and the second sets of apertures, the third set of apertures having at least approximately equivalent diameters and spacings as the first and the second sets of apertures; and wherein the wheel is rotatably connected to the hobby servo motor through the hobby servo horn such that rotation of the hobby servo motor is transferred to the wheel; and wherein a center aperture and an outer circumference of the wheel are concentric.

6. The kit of claim 1 and further comprising:

a flat rectangular support panel having a length and a width, the support panel having a plurality of sets of apertures, at least two of the plurality of sets of apertures running along the length and at least six of the plurality of sets of apertures running along the width, each of the plurality of sets of apertures having the same number of apertures as the first and the second sets of apertures, and each of the plurality of sets of apertures having at least approximately equivalent diameters and spacings as the first and the second sets of apertures; and wherein the first set of apertures includes at least two apertures that are spaced apart from each other by one hundred and eighty degrees.

7. The kit of claim 1 and further comprising:

a flat bracket having two sets of apertures, the two sets of apertures being spaced apart from each other such that neither of the two sets of apertures shares a common aperture with the other set of apertures, each of the two sets of apertures having the same number of apertures as the first and the second sets of apertures, and each of the two sets of apertures having at least approximately equivalent diameters and spacings as the first and the second sets of apertures; and wherein the second set of apertures includes at least two apertures that are spaced apart from each other by less than ninety degrees.

8. The kit of claim 1 and further comprising:

an angle bracket having a first portion and a second portion that connect to each other at an approximately right angle, each of the first and second portions of the angle bracket having a set of apertures that has the same number of apertures as the first and the second sets of apertures, and each of the angle bracket sets of apertures having at least approximately equivalent diameters and spacings as the first and the second sets of apertures; and wherein an angular position of the rotatable output shaft is controlled by a coded signal on an input line.

9. The kit of claim 1, wherein the second component is a wheel having a smooth surface that surrounds an outer perimeter of the wheel, and wherein an internal potentiometer of the hobby servo motor has been replaced in a control scheme with an external potentiometer.

10. The kit of claim 1, wherein the first set of satellite apertures has fewer apertures than the second set of satellite apertures, wherein the diameters of the apertures in the second set of apertures are larger than the diameters of the apertures in the first set of apertures, and wherein the kit includes a mounting bracket that mounts at least two hobby servo motors back-to-back, and wherein the first set of satellite apertures are spaced apart from the first center aperture by a first radial distance, wherein the second set of satellite apertures are spaced apart from the first center aperture by a second radial distance, wherein the first radial distance is less than the second radial distance, and wherein the first center aperture is utilized to create a pivot joint by placing a rotatable bar through the first center aperture.

11. The kit of claim 1, wherein the third component is distinct from the second component and wherein the second component has a third set of apertures, the third set of apertures including a second center aperture and a third set of satellite apertures each having a diameter, the second center aperture having a diameter that is larger than the diameter of the third set of satellite apertures and is substantially equivalent to the diameter of the first center aperture, wherein at least one of the second set of satellite apertures is aligned between and equally spaced from the first and second center apertures.

12. A hobby mechanical kit, the kit comprising:

a hobby servo motor having a rotatable output shaft, the output shaft having gear teeth distributed around an outer diameter of the shaft;

a first component having a first set of apertures, the first set of apertures including a center aperture, a first set of satellite apertures, and a second set of satellite apertures, each of the center aperture, the first set of satellite apertures, and the second set of satellite apertures having a diameter, the diameters of the center aperture, the first set of satellite apertures, and the second set of satellite apertures being different than each other, the first and the second sets of satellite apertures being spaced apart from the center aperture by radial distances with at least two of the radial distances being unequal, the first set of satellite apertures including a different number of apertures than the second set of satellite apertures; wherein each of the apertures in the first set of satellite apertures is spaced evenly apart from each of the other apertures in the first set of satellite apertures, wherein each of the apertures in the second set of satellite apertures is spaced evenly apart from each of the other apertures in the second set of satellite apertures;

a second component having a second set of apertures, the second set of apertures including a same number of apertures as the first set of apertures, and the second set of apertures having at least approximately equivalent diameters and spacings as the first set of apertures; and wherein the second component is a wheel having a smooth surface that surrounds an outer perimeter of the wheel, and wherein each of the apertures in the second set of satellite apertures is spaced evenly apart from the center aperture.

13. The kit of claim 12, wherein the second component is a gear having gear teeth that surround an outer perimeter of the gear, and wherein each of the apertures in the first set of satellite apertures is spaced evenly apart from the center aperture.

14. The kit of claim 12, wherein the first set of satellite apertures has fewer apertures than the second set of satellite apertures, and wherein the first set of satellite apertures and the second set of satellite apertures are angularly offset from each other such that none of the apertures in the first set of satellite apertures is aligned with any of the apertures in the second set of satellite apertures in a radial direction.

15. The kit of claim 14, wherein the first set of satellite apertures are spaced apart from the center aperture by a first radial distance, wherein the second set of satellite apertures are spaced apart from the center aperture by a second radial distance, wherein the first radial distance is less than the second radial distance, wherein the first radial distance is a same distance for each of the apertures in the first set of satellite apertures, and wherein the second radial distance is a same second distance for each of the apertures in the second set of satellite apertures.

16. The kit of claim 12 and further comprising:

a channel having a first panel, a second panel, and a third panel, each of the first, the second, and the third panels including a plurality of sets of apertures; and wherein the rotatable output shaft is limited to a range of less than two hundred degrees.

17. The kit of claim 12 and further comprising:

a hobby servo mounting bracket having a center panel, a lower panel, and two flanges, the lower panel and the two flanges being approximately parallel to each other and at right angles with respect to the center panel, the two flanges including apertures configured to secure the hobby servo motor to the mounting bracket; and wherein the rotatable output shaft has a range of greater than two hundred degrees.

18. The kit of claim 12 and further comprising:

a hobby servo mounting bracket that is configured to support at least two hobby servo motors, the bracket having a center panel, a first set of flanges, and a second set of flanges, the first and the second sets of flanges being approximately parallel to each other and at right angles with respect to the center panel, the first set of flanges including apertures configured to secure the hobby servo motor to the mounting bracket, the second set of flanges including apertures configured to secure a second hobby servo motor to the mounting bracket;

a flat rectangular support panel having a length and a width, the support panel having a plurality of sets of apertures, at least two of the plurality of sets of apertures running along the length and at least six of the plurality of sets of apertures running along the width;

a flat bracket having two sets of apertures, the two sets of apertures being spaced apart from each other such that neither of the two sets of apertures shares a common aperture with the other set of flat bracket apertures; and an angle bracket having a first portion and a second portion that connect to each other at an approximately right angle, each of the first and second portions of the angle bracket having a set of apertures; and a collar component that is configured to couple a rotatable shaft to one of the apertures to form a pivot joint.

19. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures;

a third component that includes a second set of apertures, the second set of apertures having a same number of apertures as the first set of apertures, the second set of apertures having at least approximately equivalent diameters and spacings as the first set of apertures;

a hobby servo motor mounting bracket having a center panel, a lower panel, and two flanges, the lower panel and the two flanges being approximately parallel to each other and at right angles with respect to the center panel, the two flanges including apertures configured to secure the hobby servo motor to the mounting bracket, the center panel having a third set of apertures, the third set of apertures having the same number of apertures as the first and the second sets of apertures, and the third set of apertures having at least approximately equivalent diameters and spacings as the first and the second sets of apertures; and wherein each of the apertures in the first set of satellite apertures is spaced apart from each other at a same angular distance, wherein each of the apertures in the second set of satellite apertures is spaced apart from each other at a same second angular distance that is different than the same angular distance of the first set of satellite apertures, wherein the same angular distance is defined by three hundred and sixty degrees divided by a number of the apertures in the first set of satellite apertures, wherein the same second angular distance is defined by three hundred and sixty degrees divided by a number of the apertures in the second set of satellite apertures.

20. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures;

a third component that includes a second set of apertures, the second set of apertures having a same number of apertures as the first set of apertures, the second set of apertures having at least approximately equivalent diameters and spacings as the first set of apertures;

a hobby servo motor mounting bracket that is configured to support at least two hobby servo motors, the bracket having a center panel, a first set of flanges, and a second set of flanges, the first and the second sets of flanges being approximately parallel to each other and at right angles with respect to the center panel, the first set of flanges including apertures configured to secure the hobby servo motor to the mounting bracket, the second set of flanges including apertures configured to secure a second hobby servo motor to the mounting bracket, the center panel having a third set of apertures, the third set of apertures having the same number of apertures as the first and the second sets of apertures, and the third set of apertures having at least a approximately equivalent diameters and spacings as the first and the second sets of apertures; and wherein the first set of satellite apertures and the second set of satellite apertures are angularly offset from each other such that none of the apertures in the first set of satellite apertures is aligned with any of the apertures in the second set of satellite apertures in a radial direction.

21. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures;

a third component that includes a second set of apertures, the second set of apertures having a same number of apertures as the first set of apertures, the second set of apertures having at least approximately equivalent diameters and spacings as the first set of apertures;

a gear having a third set of apertures, the third set of apertures having the same number of apertures as the first and the second sets of apertures, the third set of apertures having at least approximately equivalent diameters and spacings as the first and the second sets of apertures; and wherein the gear is rotatably connected to the hobby servo motor through the hobby servo horn such that rotation of the hobby servo motor is transferred to the gear; and wherein the second set of satellite apertures includes at least one more aperture than the first set of satellite apertures.

22. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures;

a third component that includes a second set of apertures, the second set of apertures having a same number of apertures as the first set of apertures, the second set of apertures having at least approximately equivalent diameters and spacings as the first set of apertures;

a wheel having a third set of apertures, the third set of apertures having the same number of apertures as the first and the second sets of apertures, the third set of apertures having at least approximately equivalent diameters and spacings as the first and the second sets of apertures;

wherein the wheel is rotatably connected to the hobby servo motor through the hobby servo horn such that rotation of the hobby servo motor is transferred to the wheel; and wherein a center aperture and an outer circumference of the wheel are concentric.

23. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures;

a third component that includes a second set of apertures, the second set of apertures having a same number of apertures as the first set of apertures, the second set of apertures having at least approximately equivalent diameters and spacings as the first set of apertures;

a flat bracket having two sets of apertures, the two sets of apertures being spaced apart from each other such that neither of the two sets of apertures shares a common aperture with the other set of apertures, each of the two sets of apertures having the some number of apertures as the first and the second sets of apertures, and each of the two sets of apertures having at least approximately equivalent diameters and spacings as the first and the second sets of apertures; and wherein the second set of apertures includes at least two apertures that are spaced apart from each other by less than ninety degrees.

24. A hobby mechanical kit, the kit comprising:

a hobby servo motor having a rotatable output shaft, the output shaft having gear teeth distributed around an outer diameter of the shaft;

a first component having an inner diameter with gear teeth that correspond to the hobby servo output shaft gear teeth;

a second component having a first set of apertures, the first set of apertures including a center aperture, a first set of satellite apertures, and a second set of satellite apertures, each of the center aperture, the first set of satellite apertures, and the second set of satellite apertures having a diameter, the diameter of the center aperture being larger than the diameters of the first and the second sets of satellite apertures, the first and the second sets of satellite apertures being spaced apart from the center aperture by radial distances with at least two of the radial distances being unequal, the first set of satellite apertures including a different number of apertures than the second set of satellite apertures, wherein locations of the first and the second sets of satellite apertures relative to the center aperture are defined utilizing a polar coordinate system, wherein each location is specified by a radius coordinate and an angle coordinate, wherein each radius coordinate is a distance from an origin of the polar coordinate system, wherein each angle coordinate is an angle from a polar axis of the polar coordinate system, wherein the radius coordinate for each aperture in the first set of satellite apertures is a same value, wherein the radius coordinate for each aperture in the second set of satellite apertures is a same second value that is different than the same value for the first set of satellite apertures, and wherein the angle coordinates for each of the satellite apertures in the first set of satellite apertures is different than the angle coordinates for each of the satellite apertures in the second set of satellite apertures;

a third component that includes a second set of apertures, the second set of apertures having a same number of apertures as the first set of apertures, the second set of apertures having at least approximately equivalent diameters and spacings as the first set of apertures; and wherein the first set of satellite apertures has fewer apertures than the second set of satellite apertures, wherein the diameters of the apertures in the second set of apertures are larger than the diameters of the a apertures in the first set of apertures, and wherein the kit includes a mounting bracket that mounts at least two hobby servo motors back-to-back, and wherein the first set of satellite apertures are spaced apart from the first center aperture by a first radial distance, wherein the second set of satellite apertures are spaced apart from the first center aperture by a second radial distance, wherein the first radial distance is less than the second radial distance, and wherein the first center aperture is utilized to create a pivot joint by placing a rotatable bar through the first center aperture.

* * * * *